US007726157B2

(12) United States Patent
Lim et al.

(10) Patent No.: US 7,726,157 B2
(45) Date of Patent: Jun. 1, 2010

(54) CLOTHING MANAGING APPARATUS

(75) Inventors: Sang Gyu Lim, Daegu (KR); Jae Cheol Lyu, Changwon-si (KR)

(73) Assignee: LG Electronics Inc., Seoul (KR)

( * ) Notice: Subject to any disclaimer, the term of this patent is extended or adjusted under 35 U.S.C. 154(b) by 13 days.

(21) Appl. No.: 11/792,240

(22) PCT Filed: Dec. 23, 2005

(86) PCT No.: PCT/KR2005/004498

§ 371 (c)(1),
(2), (4) Date: Jul. 17, 2007

(87) PCT Pub. No.: WO2006/095956

PCT Pub. Date: Sep. 14, 2006

(65) Prior Publication Data

US 2008/0304937 A1 Dec. 11, 2008

(30) Foreign Application Priority Data

Jan. 25, 2005 (KR) ..... 10-2005-0006652
Jan. 25, 2005 (KR) ..... 10-2005-0006653

(51) Int. Cl.
*D06F 33/02* (2006.01)

(52) U.S. Cl. ..... 68/3 R; 68/20

(58) Field of Classification Search ..... 68/3 R, 68/20

See application file for complete search history.

(56) References Cited

U.S. PATENT DOCUMENTS 3,509,605 A * 5/1970 More ..... 411/523
4,003,613 A * 1/1977 Oakley ..... 312/293.2
4,268,098 A * 5/1981 Kretchman et al. ..... 312/210
4,572,596 A * 2/1986 Weir et al. ..... 312/257.1
5,584,549 A * 12/1996 Lybarger et al. ..... 312/265
5,971,510 A * 10/1999 Lickiss et al. ..... 312/263
6,371,583 B1 * 4/2002 Visin ..... 312/228
6,837,555 B2 * 1/2005 Byrne et al. ..... 312/228
7,269,979 B2 * 9/2007 Lyu et al. ..... 68/3 R
7,490,492 B2 * 2/2009 Kim et al. ..... 68/12.27
2004/0154909 A1 * 8/2004 Kim et al. ..... 200/296
2004/0164657 A1 8/2004 Park et al.
2005/0225218 A1 * 10/2005 Cheo et al. ..... 312/279

FOREIGN PATENT DOCUMENTS

CA 2 330 236 * 11/2001
DE 44 22 000 * 1/1996
JP 54-146466 11/1979

* cited by examiner

*Primary Examiner*—Frankie L Stinson
(74) *Attorney, Agent, or Firm*—McKenna Long & Aldridge LLP

(57) ABSTRACT

A clothing managing apparatus is provided. In the clothing managing apparatus, a panel coupling protrusion (130) has a plurality of sub protrusions (131, 132) for supporting a control panel (150) in different directions, and protrusions coupling hole portion (160) receives the panel coupling protrusion (130). A holder (120) can be provided to support the control panel (150) and a top cover (100). The holder (12) includes one portion (123) coupled to the control panel (150) and the other portion (122) coupling to the top cover (100).

17 Claims, 4 Drawing Sheets

[Fig. 1]
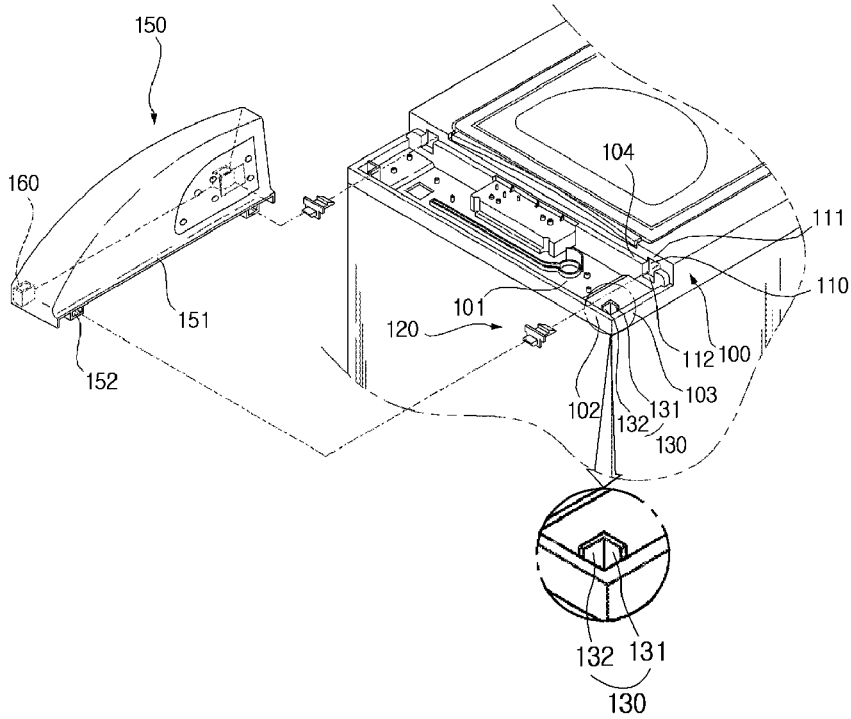
[Fig. 2]
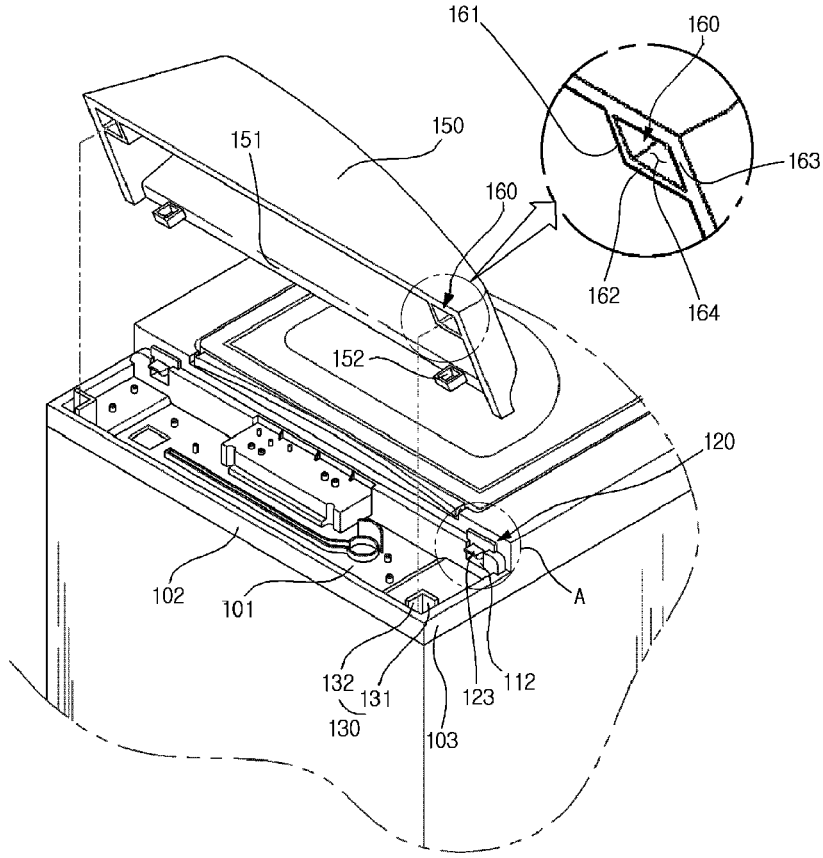

[Fig. 3]
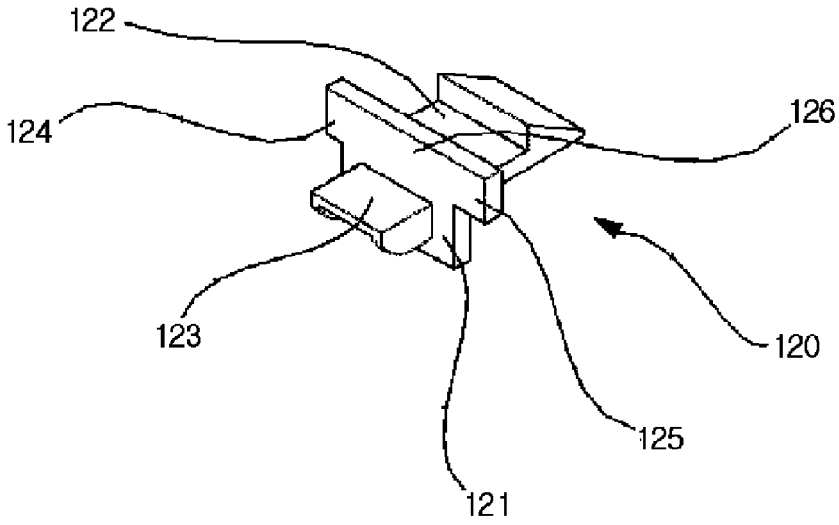
[Fig. 4]
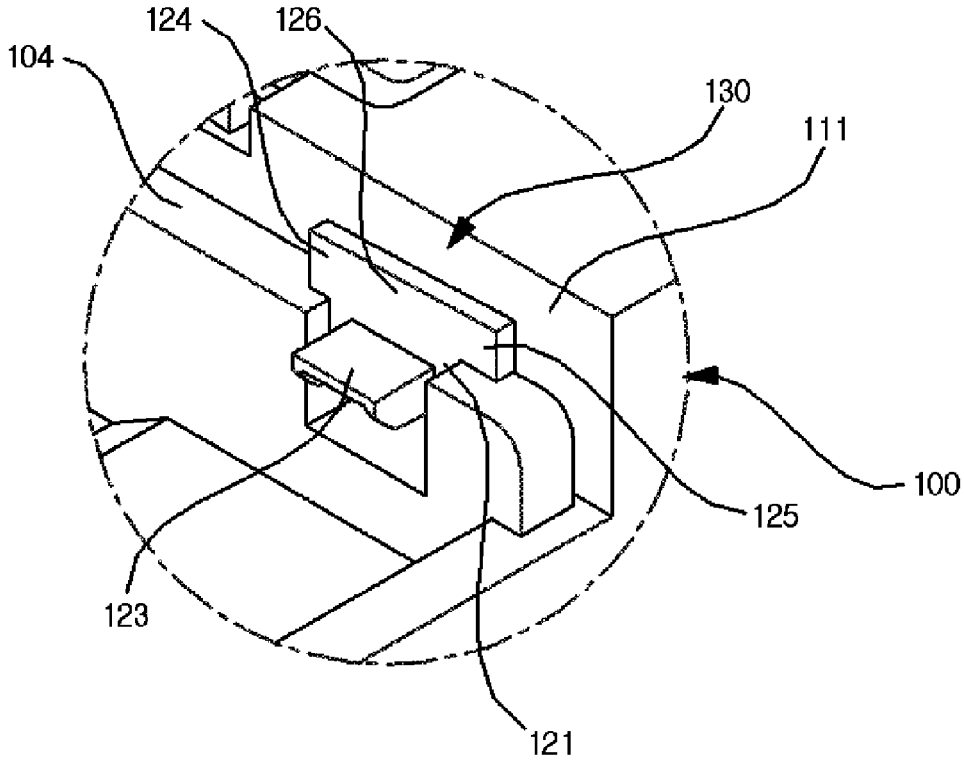

[Fig. 5]
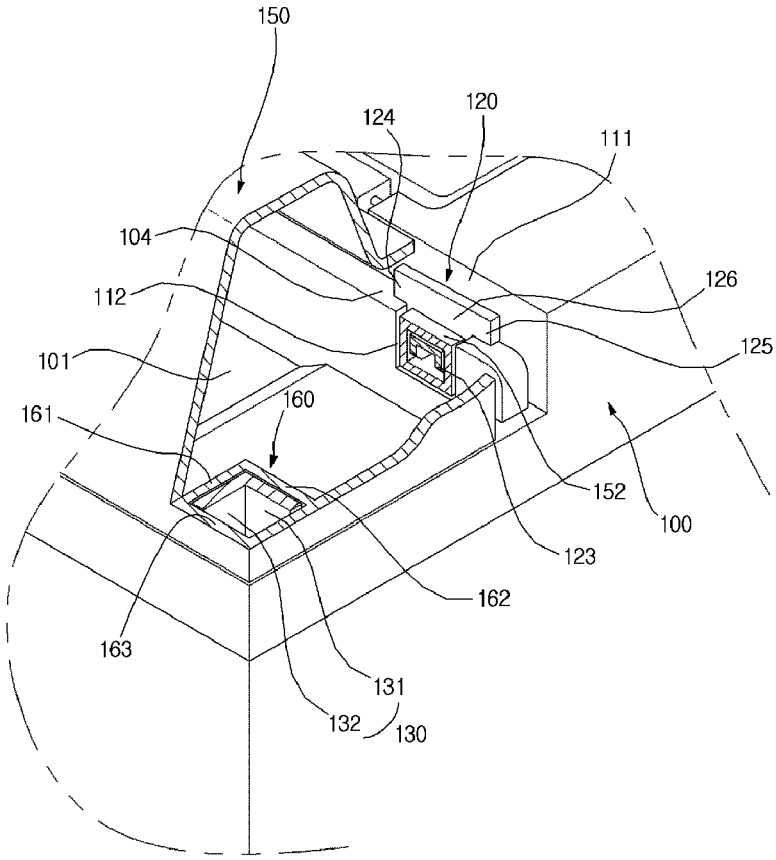
[Fig. 6]
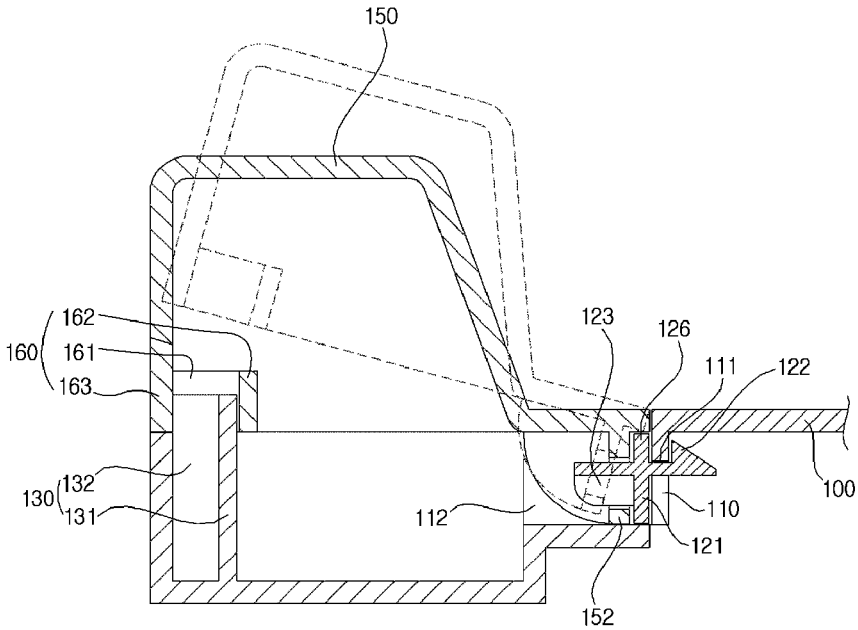

[Fig. 7]
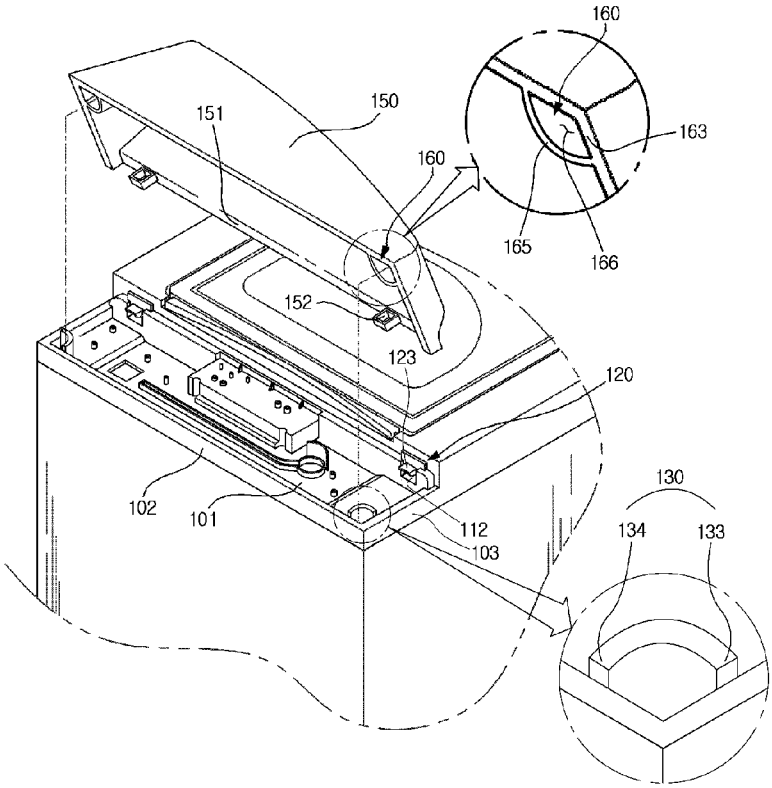
[Fig. 8]
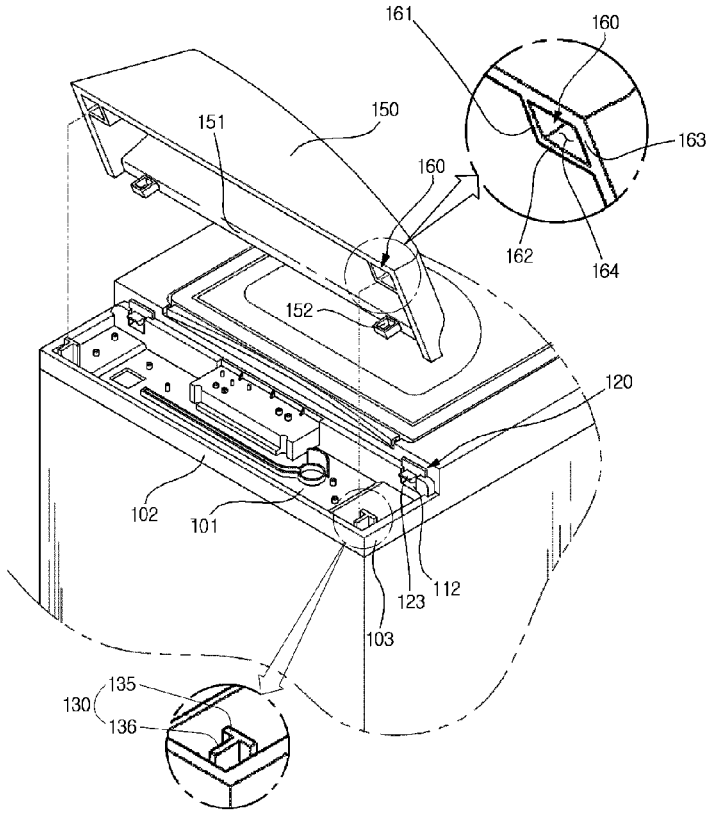

CLOTHING MANAGING APPARATUS

This application claims priority to International application No. PCT/KR2005/004498 filed on 23 Dec. 2005, Korean (KR) Application Nos. 10-2005-0006653 filed on 25 Jan. 2005; and KR Application No. 10-2005-0006652 filed 25 Jan. 2005, all of which are incorporated by reference, as is fully set forth herein.

TECHNICAL FIELD

The present invention relates to a clothing managing apparatus, and more particularly, to a clothing managing apparatus with an improved structure for coupling a control panel to a top cover.

BACKGROUND ART

A clothing managing apparatus is a device that washes, dries, and regenerates clothes. Examples of the clothing managing apparatus include a washing machine, a clothes drier, and a clothes regenerating device.

Such a clothing managing apparatus includes a top cover on a top and a control panel installed on a top end of the top cover. The control panel includes various operation keys and a control unit.

In a clothing managing apparatus of the related art, a control panel includes a hook formed on a bottom front and a stopping protrusion formed on a bottom rear. The hook is formed integrally with the control panel, and the stopping protrusion is projected from an inner surface of the control panel in a ¬-shape. A lower end of the stopping protrusion is inserted into a stopping hole defined in the top cover. The stopping hole is larger than the stopping protrusion such that the stopping protrusion can be easily inserted into the stopping hole.

The hook is caught by a predetermined portion of the top cover, and the stopping protrusion is inserted into the stopping hole, such that the control panel can be coupled to the top cover.

However, in the clothing managing apparatus of the related art, the stopping protrusion inserted in the stopping hole may wobble. Therefore, when the clothing managing apparatus vibrates during operation, the stopping protrusion wobbles continuously, resulting in damage/breakage of the stopping protrusion.

Further, since the stopping protrusion is ¬-shaped, it is difficult to make a mold for the control panel. Furthermore, since the stopping protrusion of the control panel is formed by undercutting, the stopping protrusion cannot be easily inserted into the stopping hole due to burrs on the cut surface.

In addition, since the hook is formed integrally with the control panel, the hook may be easily damaged/broken by impacts or other reasons, and in this case, the entire control panel has to be replaced.

DISCLOSURE OF INVENTION

Technical Problem

An object of the present invention is to provide a clothing managing apparatus in which a part for coupling a control panel to a top cover can be prevented from damaging and breaking.

Another object of the present invention is to provide a clothing managing apparatus that has an improved part for coupling a control panel to a top cover, such that when the coupling part is damaged or broken, only the coupling part can be replaced without replacing the entire control panel or the top cover, thereby reducing cost.

Technical Solution

In an aspect of the present invention, there is provided a clothing managing apparatus including: a top cover; a control panel installed on the top cover; a panel coupling protrusion including a plurality of sub protrusions for supporting the control panel in different directions; and a protrusion coupling hole portion into which the panel coupling protrusion is inserted.

In another aspect of the present invention, there is provided a clothing managing apparatus including: a top cover; a control panel installed on the top cover; and a holder coupled to the control panel and the top cover for supporting the control panel and the top cover.

In a further another aspect of the present invention, there is provided a clothing managing apparatus including: a top cover; a control panel installed on the top cover; a panel coupling protrusion including a plurality of sub protrusions for supporting the control panel in different directions; a protrusion coupling hole portion into which the panel coupling protrusion is inserted; and a holder coupled to the control panel and the top cover for supporting the control panel and the top cover.

ADVANTAGEOUS EFFECTS

According to the clothing managing apparatus of the present invention, since the panel coupling protrusion and the protrusion coupling hole portion are formed on the top cover and the control panel, the control panel can be prevented from wobbling in front, back, right, and left directions. Therefore, when the control panel is coupled to the top cover, the panel coupling protrusion inserted in the protrusion coupling hole portion can be prevented from wobbling, and thus, the panel coupling protrusion can be prevented from damaging/breaking.

Further, according to the clothing managing apparatus of the present invention, since the holder used to couple the front end of the control panel to the top cover is a separate part from the control panel and the top cover, the holder can be replaced with new one when it is damaged or broken. Therefore, the installation process of the control panel can be performed with less cost, compared to the related art where the entire control panel has to be replaced when a coupling portion of the control panel is damaged/broken.

Furthermore, according to the clothing managing apparatus of the present invention, since the panel coupling protrusion is protruded from the top cover, undercutting is not required to form the panel coupling protrusion. Therefore, burrs or other disadvantages resulting from the undercutting can be eliminated, and the control panel can be smoothly coupled to the top cover.

BRIEF DESCRIPTION OF THE DRAWINGS

FIG. 1 is an exploded perspective view showing an upper portion of a washing machine according to a first embodiment of the present invention.

FIG. 2 is a perspective view showing a control panel before the control panel is coupled to a top cover according to the first embodiment of the present invention.

FIG. 3 is a perspective view showing a holder according to the first embodiment of the present invention.

FIG. 4 is an enlarged view of portion A of FIG. 2, showing a holder installed on the top cover.

FIG. 5 is a partial cut-away perspective view showing the control panel when the control panel is coupled to the top cover according to the first embodiment of the present invention.

FIG. 6 is a vertical sectional view showing coupling of the control panel to the top cover according to the first embodiment of the present invention.

FIG. 7 is a perspective view showing a control panel before the control panel is coupled to a top cover according to a second embodiment of the present invention.

FIG. 8 is a perspective view showing a control panel before the control panel is coupled to a top cover according to a third embodiment of the present invention.

BEST MODE FOR CARRYING OUT THE INVENTION

Reference will now be made in detail to the preferred embodiments of the present invention, examples of which are illustrated in the accompanying drawings. It will be apparent to those skilled in the art that various modifications and variations can be made in the present invention. Thus, it is intended that the present invention covers the modifications and variations of this invention provided they come within the scope of the appended claims and their equivalents.

Meanwhile, a clothing managing apparatus of the present invention will now be described using a washing machine as an example of the clothing managing apparatus. However, the present invention is not limited to the washing machine. The present invention can be applied to other type clothing managing apparatuses.

FIG. 1 is an exploded perspective view showing an upper portion of a washing machine according to a first embodiment of the present invention.

Referring to FIG. 1, the washing machine includes a top cover 100 on an upper portion. The top cover 100 includes a panel receiving portion 101 on a rear portion. The panel receiving portion 101 receives a control panel 150. The top cover 100 includes panel coupling protrusions 130 and holders 120 to hold the control panel 150 on the panel receiving portion 101.

The top cover 100 includes side portions 103 stepped down to a predetermined depth. The side portions 103 are connected with a rear portion 102 of the top cover 100 to form the panel receiving portion 101. Therefore, the panel receiving portion 101 is lower than a front side of the top cover 100 by a predetermined depth. The panel receiving portion 101 is formed to receive the control panel 150.

The panel receiving portion 101 includes holder front coupling holes 110 in a front portion. The holder front coupling holes 110 couples with the holders 120. Reference numeral 111 denotes a top of the holder front coupling hole 110, and reference numeral 112 denotes a bottom of the holder front coupling hole 110. The holder front coupling holes 110 are defined in right and left sides of the panel receiving portion 101, respectively. The number and positions of the holder front coupling holes 110 are not limited to the number and positions illustrated in FIG. 1. When the holder front coupling holes 110 are provided in pair on the right and left sides of the panel receiving portion 101 as shown in FIG. 1, the control panel can be more firmly coupled to the panel receiving portion 101 by fitting the holders 120 into the pair of holder front coupling holes 110.

A stepped portion 104 is formed between the holder front coupling holes 110. The step 104 is shaped like a stair between the panel receiving portion 101 and an upper end of the washing machine. The stepped portion 104 receives a front end 151 of the control panel 150 when the control panel 150 is coupled to the panel receiving portion 101. Therefore, even when the control panel 150 receives a force in a front direction, the control panel 150 can be prevented from wobbling in the front direction since the stepped portion 104 supports the front end 151 of the control panel 150.

The panel coupling protrusions 130 are formed on a rear of the panel receiving portion 101. In detail, the panel coupling protrusions 130 are formed on corners of the panel receiving portion 101 where the side portions 103 of the top cover 100 meet the rear portion 102. The panel coupling protrusions 130 are slightly spaced apart from the side portions 103 and the rear portion 102. The panel coupling protrusions 130 couples with protrusion coupling hole portions 160 of the control panel 150. By fitting the panel coupling protrusions 130 into the protrusion coupling hole portions 160 of the control panel 150, the control panel 150 can be fixed to the top cover 100.

Each of the panel coupling protrusions 130 includes a front-and-back sub protrusion 131 and a right-and-left sub protrusion 132. The front-and-back sub protrusion 131 has a forward-facing surface and a backward-facing surface, and the right-and-left sub protrusion 132 has a right-facing surface and a left-facing surface. The front-and-back sub protrusion 131 is slightly spaced apart from the side portion 103 of the top cover 100, and the right-and-left sub protrusion 132 is slightly spaced apart from the rear portion 102 of the top cover 100. The front-and-back sub protrusion 131 and the right-and-left sub protrusion 132 are connected with each other at a right angle. The front-and-back sub protrusion 131 and the right-and-left sub protrusion 132 prevent the control panel from wobbling in front and back directions and in right and left directions when a force acts on the control panel 150. Since the control panel 150 receives a force mainly in front, back, right, and left directions, the sub protrusions 131 and 132 are formed based on the four directions to effectively fix the control panel 150. The front-and-back sub protrusion 131 and the right-and-left sub protrusion 132 can be connected with each other at various other angles instead of being connected at the right angle.

The panel coupling protrusion 130 is higher than the side portions 103 and the rear portion 102 of the top cover 100 by a predetermined length. Therefore, when the control panel 150 is installed on the top cover 100, the panel coupling protrusion 130 is inserted into the protrusion coupling hole portion 160 before a bottom surface of the control panel 150 makes contact with a top surface of the top cover 100. In this case, a worker can easily check the coupling between the panel coupling protrusion 130 and the protrusion coupling hole portion 160. That is, the coupling can be easily done. The contact surface between the panel coupling protrusion 130 and the protrusion coupling hole portion 160 increases in proportion to the protruded height of the panel coupling protrusion 130, thereby preventing the control panel 150 from wobbling more effectively.

The control panel 150 includes various control portions such as pads and buttons and a display unit for showing the operational state of the washing machine. The control panel 150 includes holder rear coupling holes 152 in a front bottom portion and the protrusion coupling hole portions 160 in a bottom rear portion. Each of the holder rear coupling holes 152 receives a portion of the holder 120, and the each of the protrusion coupling hole portions 160 receives the panel coupling protrusion 130.

FIG. 2 is a perspective view showing the control panel 150 before the control panel 150 is coupled to the top cover 100 according to the first embodiment of the present invention.

Referring to FIG. 2, the holders 120 are coupled to the holder front coupling holes 110 of the top cover 100. When assembled, the panel coupling protrusions 130 are coupled with the protrusion coupling hole portions 160. The protrusion coupling hole portions 160 may be defined in corners 163 of the control panel 150 in correspondence with the panel coupling protrusions 130 of the top cover 100.

Each of the protrusion coupling hole portions 160 is formed by the corner 163 of the control panel 150, a front-and-back hole wall 162, and a right-and-left hole wall 161. The front-and-back hole wall 162 and the right-and-left hole wall 161 are extended from the corner 163 and have a predetermined lengths. The front-and-back hole wall 162 has a front-facing surface and a back-facing surface, and the right-and-left hole wall 161 has a right-facing surface and left-facing surface. The front-and-back hole wall 162 and the right-and-left hole wall 161 are connected with each other. Therefore, the corner 163, the front-and-back hole wall 162, and the right-and-left hole wall 161 are connected together, such that the protrusion coupling hole portion 160 has a rectangular column shape with a hole 164 therein.

The hole 164 receives the panel coupling protrusion 130. The front-and-back hole wall 162 and the right-and-left hole wall 161 have shapes corresponding to the front-and-back sub protrusion 131 and the right-and-left sub protrusion 132 of the panel coupling protrusion 130. Therefore, when the panel coupling protrusion 130 is inserted into the hole 164, the front-and-back sub protrusion 131 and the right-and-left sub protrusion 132 are entirely brought into contact with the front-and-back hole wall 162 and the right-and-left hole wall 161, respectively. Thus, when the panel coupling protrusion 130 receives a force, the panel coupling protrusion 130 can be prevented from wobbling.

Alternatively, the front-and-back hole wall 162 and/or the right-and-left hole wall 161 can be spaced a predetermined distance apart from the corner 163.

FIG. 3 is a perspective view showing the holder 120 according to the first embodiment of the present invention, and FIG. 4 is an enlarged view of portion A of FIG. 2, showing the holder 120 installed on the top cover 100.

Referring to FIGS. 3 and 4, the holder 120 can be divided into a lower portion 121 and an upper portion 126. The lower portion 121 includes a front hook 122 extended forward in a front direction by a predetermined length and a rear protrusion 123 in a back direction by a predetermined length. The upper portion 126 includes a left stopping plate 124 extended left and a right stopping plate 125 extended right.

The front hook 122 is forwardly protruded from the lower portion 121 and has a hook-shaped end. When assembled, the front hook 122 is inserted into the holder front coupling hole 110 and caught by the top end 111 of the holder front coupling hole 110, such that the holder 120 can be fixed to the top cover 100.

The rear protrusion 123 is backwardly protruded from the lower portion 121. When assembled, the rear protrusion 123 is inserted into the holder rear coupling hole 152 and caught in the holder rear coupling hole 152, such that the holder 120 can be fixed to control panel 150. A lower edge of the rear protrusion 123 can be chamfered or rounded. In this case, when the control panel 150 is coupled to the top cover 100, the rear protrusion 123 can be smoothly inserted into the holder rear coupling hole 152 without interference with the wall of the holder rear coupling hole 152.

When the holder 120 is inserted into the holder front coupling hole 110, bottoms of the right and left stopping plates 125 and 124 are abutted against the stepped portion 104. Therefore, when the holder 120 receives a force, the holder 120 can be prevented from rolling. Further, front surfaces of the right and left stopping plates 125 and 124 are abutted against the top end 111 of the holder front coupling hole 110, so that the holder 120 can be prevented from pitching when subjected to a force. That is, the right and left stopping plates 125 and 124 prevent the holder 120 from wobbling.

FIG. 5 is a partial cut-away perspective view showing the control panel 150 when the control panel 150 is coupled to the top cover 100 according to the first embodiment of the present invention.

Referring to FIG. 5, the control panel 150 is coupled to the top cover 100. The front of the control panel 150 is coupled to the top cover 100 using the holder 120, and the rear of the control panel 150 is coupled to the top cover 100 using the panel coupling protrusion 130.

The front hook 122 of the holder 120 is inserted into the holder front coupling hole 110 of the top cover 100, and the rear protrusion 123 of the holder 120 is inserted into the holder rear coupling hole 152 of the control panel 150. As described above, when the holder 120 is inserted into the holder front coupling hole 110, the holder 120 can be prevented from wobbling. Therefore, the front of the control panel 150 coupled to the rear of the holder 120 can be prevented from wobbling.

The panel coupling protrusion 130 is inserted into the protrusion coupling hole portion 160 formed on the rear of the control panel 150. In detail, when the panel coupling protrusion 130 is inserted into the protrusion coupling hole portion 160, the front-and-back sub protrusion 131 makes contact with the front-and-back hole wall 162 and the right-and-left sub protrusion 132 makes contact with the right-and-left hole wall 161, so that the rear of the rear of the control panel can be prevented from wobbling.

As mentioned above, the control panel 150 can be prevented from wobbling by using the holder 120 and the coupling protrusion 130.

Further, the holder 120 is a separate part from the control panel 150 and the top cover 100. Therefore, when the holder 120 is broken or deformed, the control panel 150 can be coupled to the top cover 100 again by replacing only the holder 120. Thus, the installation process of the control panel can be easily performed with less cost, compared to the related art where the entire control panel has to be replaced when a coupling portion of the control panel is damaged.

FIG. 6 is a vertical sectional view showing coupling of the control panel 150 to the top cover 100 according to the first embodiment of the present invention. An operation for coupling the control panel 150 to the top cover 100 in the washing machine will now be described with reference to FIG. 6 according to the current embodiment of the present invention.

First, the front hook 122 of the holder is inserted into the holder front coupling hole 110 of the top Cover 100. Next, the front hook 122 is caught by the top end 111 of the holder front coupling hole 110, so that the front hook 122 firmly held in the holder coupling hole 110.

When the front hook 122 is inserted into the holder front coupling hole 110 as described above, the right and left stopping plates 125 and 124 of the holder 120 are placed on the stepped portion 104, and the front surfaces of the right and left stopping plates 125 and 124 are abutted on the top end 111. By the right and left stopping plates 125 and 124 and the front hook 122, the holder 120 can be securely installed on the top cover 100.

Next, as shown with the dashed line of FIG. 6, the front end 151 of the control panel 150 is placed on the stepped portion 104 with the rear of the control panel 150 spaced apart from the top cover 100. In this position, the rear of the control panel 150 is rotated down while the front end 151 of the control panel 150 is held on the stepped portion 104. When the rear of the control panel 150 is rotated down, the rear protrusion 123 of the holder 120 installed on the top cover 120 is inserted into the holder rear coupling hole 152 of the control panel 150. Here, since the lower edge of the rear protrusion 123 is rounded or chamfered, the rear protrusion 123 can be smoothly inserted into the holder rear coupling hole 152.

Next, when the rear of the control panel 150 is further rotated down, the panel coupling protrusion 130 is inserted into the hole 164 of the protrusion coupling hole portion 160. Thus, the outer surface of the front-and-back sub protrusion 131 is abutted on the inner surface of the front-and-back hole wall 162, and the outer surface of the right-and-left sub protrusion 132 is abutted on the inner surface of the right-and-left hole wall 161. When the rear of the control panel 150 is completely rotated down, the panel coupling protrusion 130 is also completely inserted into the hole 164 of the protrusion coupling hole portion 160. Thus, the right-and-left sub protrusion 132 and the front-and-back protrusion 131 are abutted on the right-and-left hole wall 161 and the front-and-back hole wall 162, respectively, so that the panel coupling protrusion 130 can be prevented from wobbling in the protrusion coupling hole portion 160.

MODE FOR THE INVENTION

The present invention will now be more fully described with reference to accompanying drawings in which other embodiments of the present invention are shown. Descriptions for the same elements as the first embodiment will be omitted for conciseness.

FIG. 7 is a perspective view showing a control panel before the control panel is coupled to a top cover according to a second embodiment of the present invention.

Referring to FIG. 7, panel coupling protrusions 130 are protrude from a top cover 100 and have a predetermined curvature. Each of the panel coupling protrusion 130 includes a right sub protrusion 133 curved to the right and a rear sub protrusion 134 curved to the rear side. The light sub protrusion 133 and the rear sub protrusion 134 are connected with each other.

When assembled, the panel coupling protrusions 130 are inserted into protrusion coupling hole portions 160. Each of the protrusion coupling hole portion 160 includes a corner 163 of the a control panel 150 and an inner hole wall 165. The inner hole wall 165 is curved with a predetermined curvature. The inner hole wall 165 and the corner 163 define a hole 166 to receive the panel coupling protrusion 130. Preferably, the pre-determined curvature of the inner hole wall 165 is substantially the same as that of the panel coupling protrusion 130, so that the panel coupling protrusion 130 can be smoothly inserted into the hole 166 of the protrusion coupling hole portion 160.

Since the panel coupling protrusion 130 and the protrusion coupling hole portion 160 are curved with the predetermined curvature, they can be more smoothly and easily coupled to each other.

FIG. 8 is a perspective view showing a control panel before the control panel is coupled to a top cover according to a third embodiment of the present invention.

Referring to FIG. 8, panel coupling protrusions 130 are protrude from a top cover 100. Each of the panel coupling protrusion 130 includes a horizontal sub protrusion 135 and a vertical sub protrusion 136. The horizontal sub protrusion 135 has a front-facing surface and a back-facing surface, and the vertical sub protrusion 135 is connected to the back-facing surface of the horizontal sub protrusion 135. In detail, the vertical sub protrusion 136 is connected to the back-facing surface of the horizontal sub protrusion 135 at a predetermined position between both sides of the horizontal sub protrusion 135. The horizontal and vertical sub protrusions 135 and 136 are formed in an approximate T-shape.

When assembled, the panel coupling protrusions 130 are inserted into protrusion coupling hole portions 160. In this position, the front-facing surface and both sides of the horizontal sub protrusion 135 and a rear end of the vertical sub protrusion 136 are abutted on inner surfaces of the protrusion coupling hole portion 160, such that the panel coupling protrusion 130 can be fixed to the protrusion coupling hole portion 160.

Since the vertical sub protrusion 136 is extended from the back-facing surface of the horizontal sub protrusion 135, the horizontal sub protrusion 135 is supported by the vertical sub protrusion 136. Therefore, the strength of the panel coupling protrusion 130 can be increased.

Here, the hole defined in the protrusion coupling hole portion 160 can be T-shaped in correspondence with the panel coupling protrusion 130. In this case, the contact surface between the protrusion coupling hole portion 160 and the panel coupling protrusion 130 increases, so the protrusion coupling hole portion 160 and the panel coupling protrusion 130 can be more reliably coupled to each other.

INDUSTRIAL APPLICABILITY

According to the clothing managing apparatus of the present invention, the part for coupling the control panel to the top cover can be prevented from damaging and breaking and can be replaced with new one more easily. Therefore, industrial applicability of the present invention is very high.

The invention claimed is:

1. A clothing managing apparatus comprising:

a top cover;

a control panel installed on the top cover;

a panel coupling protrusion including a plurality of sub protrusions for supporting the control panel in different directions, the panel coupling protrusion formed on one of the top cover and the control panel and being higher than a surrounding uppermost end of the one by a predetermined length; and a protrusion coupling hole portion into which the panel coupling protrusion is inserted.

2. The clothing managing apparatus according to claim 1, wherein the panel coupling protrusion comprises:

a first sub protrusion for supporting the control panel in front and back directions; and a second sub protrusion for supporting the control panel in right and left directions.

3. The clothing managing apparatus according to claim 1, wherein the protrusion coupling hole portion is in contact with the respective sub protrusions.

4. The clothing managing apparatus according to claim 1, wherein the plurality of sub protrusions comprises:

a first sub protrusion; and a second sub protrusion connected to an end of the first sub protrusion.

5. The clothing managing apparatus according to claim 1, wherein the plurality of sub protrusions is curved with a predetermined curvature.

6. The clothing managing apparatus according to claim 1, wherein the plurality of sub protrusions comprises:

a first sub protrusion; and a second sub protrusion connected with the first sub protrusion at a predetermined position between both ends of the first sub protrusion.

7. The clothing managing apparatus according to claim 1, further comprising a holder including one portion coupled to the control panel and the other portion coupled to the top cover, for supporting the control panel and the top cover.

8. A clothing managing apparatus comprising:

a top cover;

a control panel installed on the top cover; and a holder coupled to the control panel and the top cover for supporting the control panel and the top cover, the holder including a front hook formed on a front and inserted into the top cover, and a rear protrusion formed on a rear and inserted into the control panel and having a lower edge chamfered or rounded.

9. The clothing managing apparatus according to claim 8, wherein the holder comprises a stopping plate formed on a lateral side, the stopping plate being abutted on the top cover.

10. A clothing managing apparatus comprising:

a top cover;

a control panel installed on the top cover;

a panel coupling protrusion including a plurality of sub protrusions for supporting the control panel in different directions;

a protrusion coupling hole portion into which the panel coupling protrusion is inserted; and a holder coupled to the control panel and the top cover for supporting the control panel and the top cover.

11. The clothing managing apparatus according to claim 10, wherein the panel coupling protrusion and the protrusion coupling hole portion are used to support rear sides of the top cover and the control panel, and the holder supports front sides of the top cover and the control panel.

12. The clothing managing apparatus according to claim 10, wherein the panel coupling protrusion and the protrusion coupling hole portion are formed on corners of top cover and the control panel.

13. The clothing managing apparatus according to claim 10, wherein the top cover comprises a stepped portion on which a front end of the control panel is placed.

14. The clothing managing apparatus according to claim 10, wherein the panel coupling protrusion is formed on the top cover, and the protrusion coupling hole portion is formed on the control panel.

15. The clothing managing apparatus according to claim 14, wherein the panel coupling protrusion is higher than a surrounding uppermost end of the top cover by a predetermined length.

16. The clothing managing apparatus according to claim 10, wherein the holder comprises a stopping plate formed on a lateral side, the stopping plate being abutted on the top cover.

17. The clothing managing apparatus according to claim 10, wherein the holder comprises a rear protrusion having a lower edge chamfered or rounded.

* * * * *